US005423553A

United States Patent [19]

Krieg

[11] Patent Number: 5,423,553

[45] Date of Patent: Jun. 13, 1995

[54] FLETCH CHECK TEST ARROW

[76] Inventor: Marshall Krieg, 1027 Lolena St., Honolulu, Hi. 96817

[21] Appl. No.: 317,113

[22] Filed: Oct. 3, 1994

[51] Int. Cl.[6] ..... F42B 6/06
[52] U.S. Cl. ..... 273/416; 273/420
[58] Field of Search ..... 273/416, 419–420, 273/423

[56] References Cited

U.S. PATENT DOCUMENTS

| | | | |
|---|---|---|---|
| 2,531,635 | 11/1950 | Maager | 273/420 |
| 2,876,760 | 3/1959 | Halverson | 273/416 X |
| 5,154,432 | 10/1992 | Saunders | 273/416 |
| 5,311,855 | 5/1994 | Basik | 273/420 X |

OTHER PUBLICATIONS

Bow & Arrow Hunting, Dec. 1985, pp. 16, 18; Tackle Tips.
Sporting Goods Dealer, Jan. 1972, p. 44.

*Primary Examiner*—Paul E. Shapiro
*Attorney, Agent, or Firm*—Michael I. Kroll

[57] ABSTRACT

A fletch check test arrow comprising a short shaft with a component for blunting a forward end of the short shaft. A fletching is affixed about the short shaft near the forward end thereof. A nock is on a rearward end of the short shaft. When the nock engages a serving portion of a bowstring, it will instantly show an archer if the fletching is touching a grip portion of a bow having an arrow rest, thereby causing a very erratic flight if released.

10 Claims, 2 Drawing Sheets

FLETCH CHECK TEST ARROW

BACKGROUND OF THE INVENTION

1. Field of the Invention

The instant invention relates generally to archery equipment and more specifically it relates to a fletch check test arrow.

2. Description of the Prior Art

Numerous archery equipment have been provided in prior art that are adapted assist people who shoot with bows and arrows at targets. While these units may be suitable for the particular purpose to which they address, they would not be as suitable for the purposes of the present invention as heretofore described.

SUMMARY OF THE INVENTION

A primary object of the present invention is to provide a fletch check test arrow that will overcome the shortcomings of the prior art devices.

Another object is to provide a fletch check test arrow that will instantly show an archer if a fletching will touch an arrow rest and a bow, so that when released would cause the arrow to make a very erratic flight.

An additional object is to provide a fletch check test arrow, in which the fletching can be adjusted on a short shaft using a rotatable nock to obtain maximum fletching clearance, so that all subsequent arrows can be manufactured accordingly.

A further object is to provide a fletch check test arrow that is simple and easy to use.

A still further object is to provide a fletch check test arrow that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
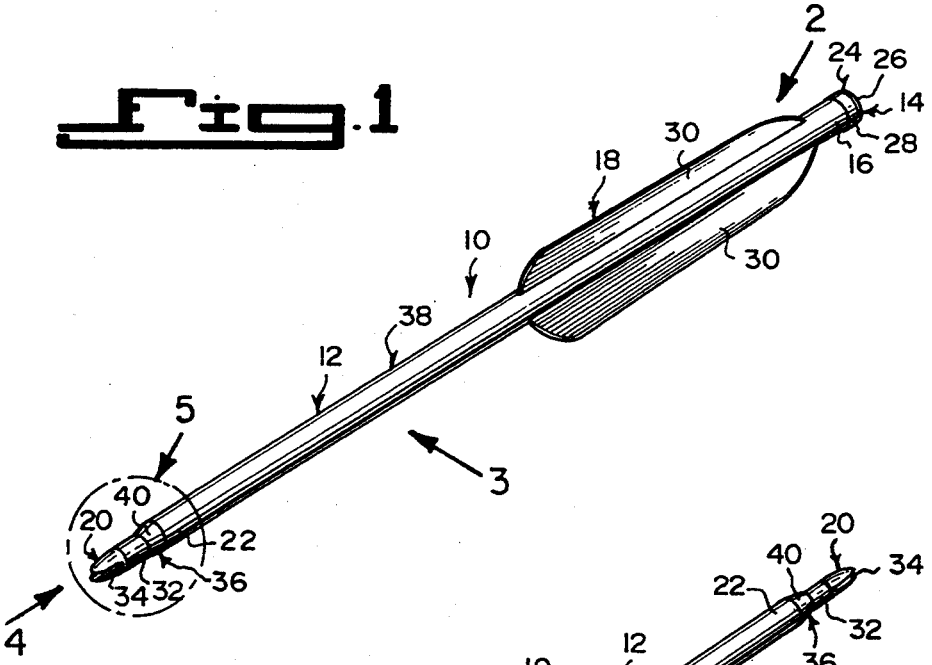
FIG. 1 is a rear perspective view of the instant invention.

Turning now descriptively to the drawings, in which similar reference characters denote similar elements throughout the several views, FIGS. 1 through 5 illustrate a fletch check test arrow 10, comprising a short shaft 12 with a component 14 for blunting a forward end 16 of the short shaft 12. A fletching 18 is affixed about the short shaft 12 near the forward end 16 thereof. A nock 20 is on a rearward end 22 of the short shaft 12. When the nock 20 engages a serving portion of a bowstring, it will instantly show an archer if the fletching 18 is touching a grip portion of a bow having an arrow rest, thereby causing a very erratic flight if released.

The short shaft 12 is of a proper length to extend across the distance between the serving portion of the bowstring and the grip portion of the bow having the arrow rest. The fletching 18 will immediately be in position without the archer having to draw back the nock 20 on the bowstring.

The blunting component 14 is a plastic cap member 24 having a top surface 26 and a depending side skirt 28, which fits over the forward end 16 of the short shaft 12. The fletching 18 includes three vanes 30 radially attached to the short shaft 12 near the forward end 16 thereof. The nock 20 consists of a head 32 having a longitudinal slot 34 therein, in which the serving portion of the bowstring can enter the slot 34.

An assembly 36 between the head 32 of the nock 20 and the rearward end 22 of the short shaft 12, is for axially rotating the short shaft 12 about the head 32 of the nock 20 to obtain maximum clearance of the fletching 18 at the grip portion of the bow having the arrow rest, so that all subsequent standard arrows can be manufactured accordingly.

The axially rotating assembly 36 consists of the short shaft 12 being a hollow tube 38. A cylindrical uni-bushing 40 is press fit onto the head 32 of the nock 20. The cylindrical uni-bushing 40 is inserted into the rearward end 22 of the hollow tube 38 of the short shaft 12, to allow the head 32 of the nock 20 to rotate three hundred and sixty degrees in clockwise and counterclockwise directions.

Figure 2:
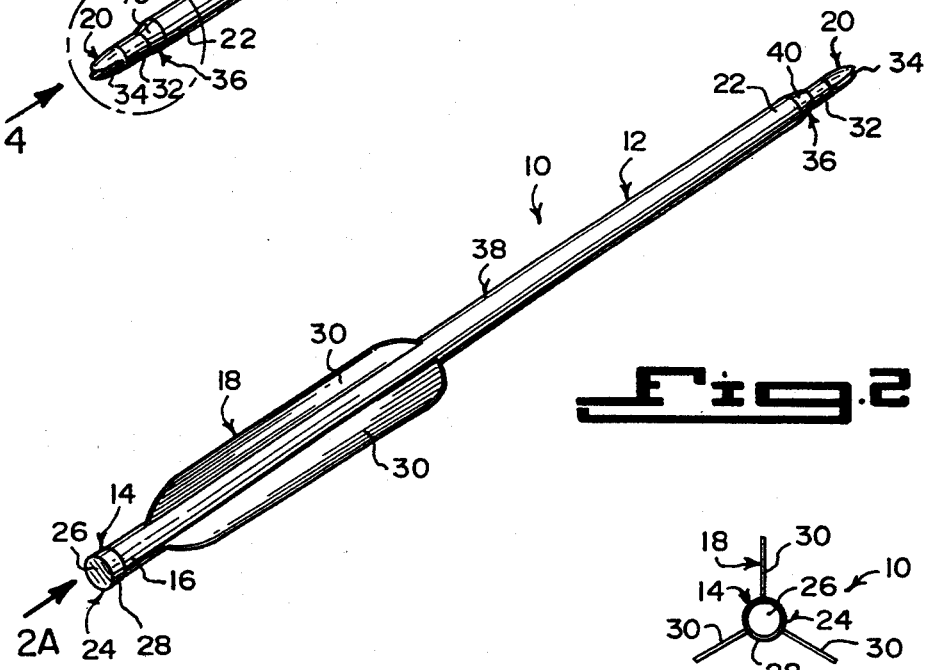
FIG. 2 is a front perspective view taken in the direction of arrow 2 in FIG. 1.
Figure 2A:
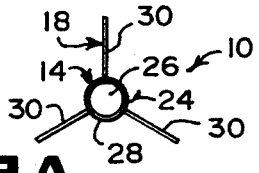
FIG. 2A is a front elevational view taken in the direction of arrow 2A in FIG. 2, showing a straight vane fletching.
Figure 3:
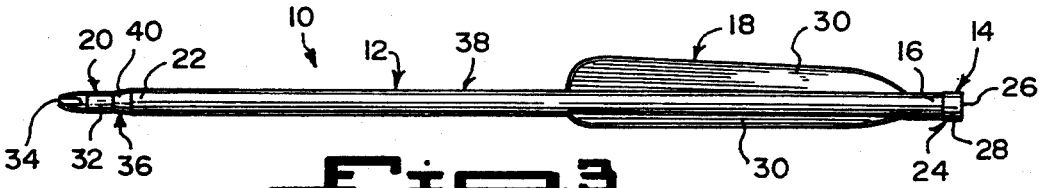
FIG. 3 is a side elevational view taken in the direction of arrow 3 in FIG. 1.
Figure 4:
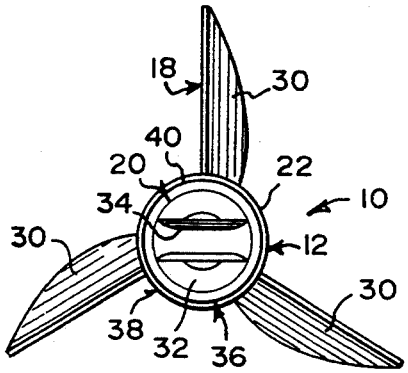
FIG. 4 is a rear elevational view taken in the direction of arrow 4 in FIG. 1, showing a right helical vane fletching.
Figure 5:
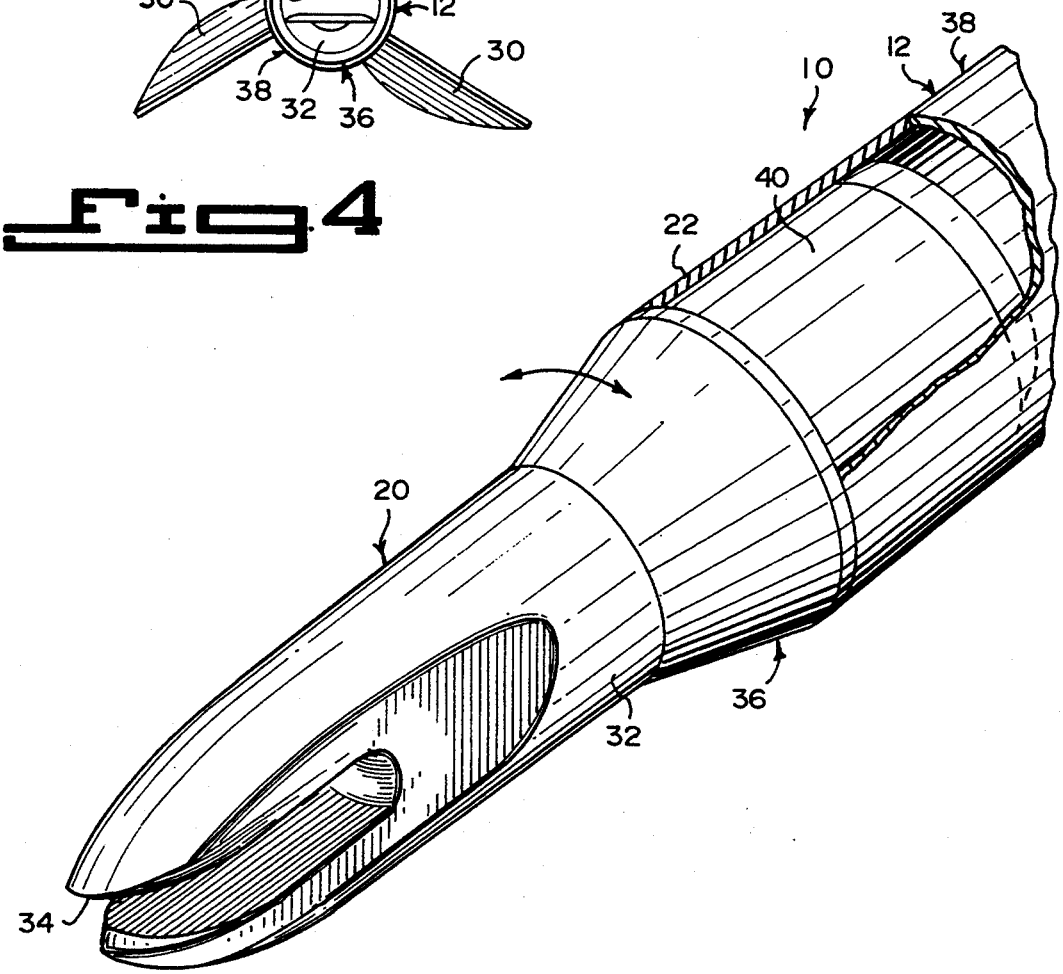
FIG. 5 is an enlarged perspective view with parts broken away and in section as indicated by arrow 5 in FIG. 1, showing the press fit uni-bushing of the rotatable nock assembly.
Figure 4A:
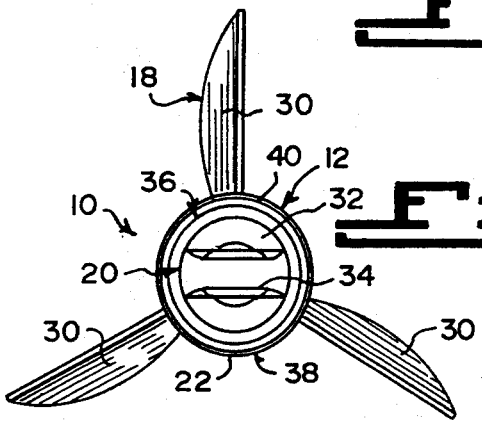
FIG. 4A is a rear elevational view similar to FIG. 4, showing a left helical vane fletching.

The vanes 30 of the fletching 18 can be in a straight formation, as shown in FIGS. 2A, in a right helical formation, shown in FIGS. 4 and in a left helical formation, shown in FIG. 4A.

OPERATION OF THE INVENTION

To use the fletch check test arrow 10, the following steps should be taken:

1. Place the slot 34 in the head 32 of the nock 20 on the serving portion of the bowstring.
2. Allow the short shaft 12 to extend across the distance between the serving portion of the bowstring and the grip portion of the bow having the arrow rest.
3. Turn the short shaft 12 longitudinally either clockwise or counterclockwise, by rotating the rearward end 22 on the cylindrical uni-bushing 40.
4. When the vanes of the fletching 18 are clear and not touching the grip portion of the bow having the arrow rest, the head 32 of the nock 20 is in its proper position with respect to the fletching 18.
5. All subsequent standard arrows can now be manufactured accordingly in this fashion.

LIST OF REFERENCE NUMBERS

10 fletch check test arrow
12 short shaft
14 blunting component 16 forward end of 12
18 fletching
20 nock
22 rearward end of 12
24 plastic cap member for 14
26 top surface of 24
28 depending side skirt of 24
30 vane of 18
32 head of 20
34 slot in 32
36 axially rotating assembly
38 hollow tube for 12
40 cylindrical uni-bushing It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A fletch check test arrow comprising:
a) a short shaft;
b) means for blunting a forward end of said short shaft;
c) a fletching affixed about said short shaft near the forward end thereof; and
d) a nock on a rearward end of said short shaft, which when said nock engages a serving portion of a bowstring, it will instantly show an archer if said fletching is touching a grip portion of a bow having an arrow rest, thereby causing a very erratic flight if released.

2. A fletch check test arrow as recited in claim 1, wherein said short shaft is of a proper length to extend across the distance between the serving portion of the bowstring and the grip portion of the bow having the arrow rest, whereby said fletching will immediately be in position without the archer having to draw back said nock on the bowstring.

3. A fletch check test arrow as recited in claim 2, wherein said blunting means is a plastic cap member having a top surface and a depending side skirt which fits over the forward end of said short shaft.

4. A fletch check test arrow as recited in claim 3, wherein said fletching includes three vanes radially attached to said short shaft near the forward end thereof.

5. A fletch check test arrow as recited in claim 4, wherein said nock includes a head having a longitudinal slot therein, in which the serving portion of the bowstring can enter said slot.

6. A fletch check test arrow as recited in claim 5, further including means between said head of said nock and the rearward end of said short shaft, for axially rotating said short shaft about said head of said nock to obtain maximum clearance of said fletching at the grip portion of the bow having the arrow rest, so that all subsequent standard arrows can be manufactured accordingly.

7. A fletch check test arrow as recited in claim 6, wherein said axially rotating means includes:
a) said short shaft being a hollow tube; and
b) a cylindrical uni-bushing press fit onto said head of said nock, whereby said cylindrical uni-bushing is inserted into the rearward end of said hollow tube of said short shaft, to allow said head of said nock to rotate three hundred and sixty degrees in clockwise and counterclockwise directions.

8. A fletch check test arrow as recited in claim 7, wherein said vanes of said fletching are in a straight formation.

9. A fletch check test arrow as recited in claim 7, wherein said vanes of said fletching are in a right helical formation.

10. A fletch check test arrow as recited in claim 7, wherein said vanes of said fletching are in a left helical formation.

* * * * *